US005743415A

United States Patent [19]

Smart

[11] Patent Number: 5,743,415

[45] Date of Patent: Apr. 28, 1998

[54] MOUNTABLE ADJUSTABLE HOLDER APPARATUS FOR HAIR APPLIANCES

[76] Inventor: Kirsten Ann Smart, 4123 N. Campbell, Chicago, Ill. 60615

[21] Appl. No.: 534,563

[22] Filed: Sep. 27, 1995

[51] Int. Cl.[6] ..... A47F 5/00; A47F 7/00

[52] U.S. Cl. ..... 211/70.6; 248/314; 248/293; D28/73; D28/38

[58] Field of Search ..... 211/70.6, 60.1, 211/87; 248/51, 52, 224.7, 224.8, 225.21, 304, 314, 315; 403/361, 359, 333, 334, 373, 374, 381, 353, 355, 326, 329; D28/38, 73

[56] References Cited

U.S. PATENT DOCUMENTS

| | | | |
|---|---|---|---|
| D. 261,818 | 11/1981 | Galuppo | D28/73 |
| D. 314,067 | 1/1991 | Ward | D28/38 |
| D. 342,585 | 12/1993 | Fischbach et al. | D28/38 |
| 462,117 | 10/1891 | Emerson | 248/314 X |
| 1,864,039 | 6/1932 | Brownson | 211/60.1 |
| 2,049,593 | 8/1936 | Schabinger | 248/315 X |
| 2,272,361 | 2/1942 | Troidl | 211/87 |
| 2,642,686 | 6/1953 | Simpson | 248/225.21 X |
| 3,091,423 | 5/1963 | Butterworth | 211/70.6 X |
| 3,443,783 | 5/1969 | Fisher | 403/353 X |
| 4,159,773 | 7/1979 | Losenno | 211/60 |
| 4,219,178 | 8/1980 | Assion | 248/314 |
| 4,673,148 | 6/1987 | Oliver | 248/293 |
| 4,746,090 | 5/1988 | Hamilton | 248/314 |
| 4,847,950 | 7/1989 | Coleman | 403/326 X |
| 4,973,019 | 11/1990 | Baird et al. | 248/314 |
| 5,039,366 | 8/1991 | Strattman | 248/205.3 X |
| 5,141,189 | 8/1992 | Andrew | 248/117.6 X |
| 5,333,744 | 8/1994 | LoCicero et al. | 211/87 |
| 5,388,359 | 2/1995 | Dewitt | 248/231.7 X |
| 5,484,066 | 1/1996 | Luisi | 248/205.3 X |
| 5,485,931 | 1/1996 | Barr, Jr. | 211/87 X |

*Primary Examiner*—Ramon O. Ramirez
*Assistant Examiner*—Long Dinh Phan
*Attorney, Agent, or Firm*—Michael R. McKenna

[57] ABSTRACT

A mountable holder for hair appliances comprising a base which may be mounted to a door or a wall, appliance securing members selectively mounted in discrete locking positions allowing access to the hair appliances to be personalized ergonomically to the characteristics of the user.

The present invention discloses a novel connecting system comprising male connectors and complementary female means for receiving which allow for angularly distinct locking positions relative to a securely positioned base.

Moreover, a preferred embodiment of the invention provides a heat resistant tube or inner sleeve employed for the tube of an appliance securing member to safely contain the heated barrel of a curling iron.

32 Claims, 5 Drawing Sheets

MOUNTABLE ADJUSTABLE HOLDER APPARATUS FOR HAIR APPLIANCES

BACKGROUND OF THE INVENTION

This invention relates to a holding apparatus for hair appliances that may be used in a commercial beauty parlor or in a consumer's home for holding a variety of hair appliances which may include hair dryers, curling irons, including associated electrical cords, brushes, and related items. Some of these electrical items are potential safety hazards because of the heat generated or the use of electricity in proximity to water. Additionally, curling irons which have heated barrels may cause burns if not properly stored.

Thus the need has arisen for a holding apparatus which can secure these various hair appliance items out of the way of harm to the user and to others who may pass by.

Alternative technology is available in the form of various hangers and holding apparatuses including U.S. Pat. No. 4,159,773 issued to Losenno in 1979 for a beautician's tool hanger which provides a frame having a variety of hooks and clips. The principal disadvantage of this device is that the electrical appliance may easily fall off one of the hooks when jostled. Moreover, the heated barrel of a curling iron is exposed, leaving open the safety hazard referenced above.

A design patent was issued to Galuppo in 1981 for hair dryer blowers as shown in U.S. Design Pat. No. D261,818. This invention provides for a section of a cylinder with cut outs that is positioned horizontally and secured with an attaching arm. The cut outs provide areas in which the nozzles of hair dryers and the like may be stored. A disadvantage of this device is that it does not safely accommodate a curling iron with a heated barrel.

Reference can also be made to U.S. Pat. No. 4,746,090 issued to Hamilton in 1988 for a hair dryer holder which provides a base which may be secured at various elevations on a wall where the base may grip the handle of a hair dryer rotatably positioned within said base to allow the nozzle of the hair dryer to be conveniently redirected. An earlier hair dryer holder which allows rotation about a vertical axis is seen in U.S. Pat. No. 4,219,178 issued to Assion in 1980.

In U.S. Pat. No. 4,673,148 issued to Oliver in 1987 for a holder for a hair dryer, a structure is revealed which provides a swivel connection for the nozzle holder. Unlike the instant invention which can position an appliance securing member in selected locking positions relative to the base, the Oliver patent employs a friction washer to regulate rotation of the holder relative to its rotatable arm.

A bathroom vertical surface organizer is disclosed in U.S. Pat. No. 5,242,063 issued to Ericksen et al. in 1993 which relates to a wall mounted base having hook and loop fastening means to secure objects thereto.

Furthermore, in 1981 Jelen received U.S. Pat. No. 4,304,382 for a pegboard and fasteners, utilizing hooks, rings and clips to secure various objects. Unlike the current invention, it does not provide a means to mount the appliances to the base at selected locking positions relative to the base nor does it provide the safety features above referenced.

To alleviate this problem, and others which will become apparent from the disclosure which follows, the present invention conveniently may be arranged to fit the height and reach of the user and which may be adjusted to accommodate a user having different physical characteristics.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

It will be seen that this improved apparatus which teaches a holding apparatus that allows the user to selectively secure the hair appliances to a mountable base at selected discrete locking positions ergometrically accommodate the individual needs of the user. The foregoing is accomplished by utilizing male connectors and complementary female means for receiving which allow for angularly distinct locking positions relative to a secured positioned base.

Moreover, if the consumer needs to mount the base in such a manner that the appliances are accessible on the right side of the base, the availability of discrete locking positions which position the securing members in such a way as to allow the appliances to be accessible from the right side is easily attainable. Similarly, if the base has to be mounted in such a way that the hair appliances have to be accessible from the left side of the base, selecting appropriate locking positions for the appliance securing members to be attached to the base can readily be accomplished as well.

Means have been provided not only for securing the base to a wall, but also for a door mounting option. The ability to selectively lock the position of the appliance securing members and thus the appliances will further allow these appliances to avoid contact with door framing and other obstacles when the base is mounted on a door.

The ability to reposition the hair appliances for ease of use by the user allows this device to be personalized ergonomically to the characteristics of the user.

To provide safety for the user and those in proximity to the appliance holder, particularly for such hair appliances as a curling iron which during use develop temperatures in the range of 350 degrees, a heat resistant tube or inner sleeve may be employed to safely contain the heated barrel of the curling iron.

Still other advantages will be apparent from the disclosure that follows.

SUMMARY OF THE INVENTION

The invention relates to a mountable adjustable holder apparatus for hair appliances comprising a base having at least one aperture, each of the apertures having a plurality of angulatingly discrete locking positions relative to the base, means for mounting the base on a permanent object such as a door or a wall, at least one appliance securing member, and means for attaching each of the appliance securing members selectively to one of the discrete locking positions of at least one of the apertures in the base which allows a hair appliance to be held in position on the base at selected angular positions relative to the base.

In another preferred embodiment of this invention, the mountable adjustable holder apparatus for hair appliances comprises a base having at least one aperture, means for mounting the base on a permanent object, at least one appliance securing member having at least one opening, each of the openings having a plurality of angulatingly discrete locking positions relative to the appliance securing member, and means for attaching the base selectively to one of the discrete locking positions of at least one of the openings in each of the appliance securing members, which allows the hair appliances to be held to the base at selected locking positions relative to the base.

The present invention discloses a novel connecting system comprising male connectors and complementary female means for receiving which allow for angularly distinct locking positions relative to a securely positioned base.

Moreover, a preferred embodiment of the invention provides a heat resistant tube or inner sleeve which may be employed for the tube of an appliance securing member to safely contain the heated barrel of a curling iron.

BRIEF DESCRIPTION OF THE DRAWINGS

Preferred embodiments of the invention are described hereinafter with reference to the accompanying drawing wherein.

DETAILED DESCRIPTION OF THE INVENTION

Figure 1:
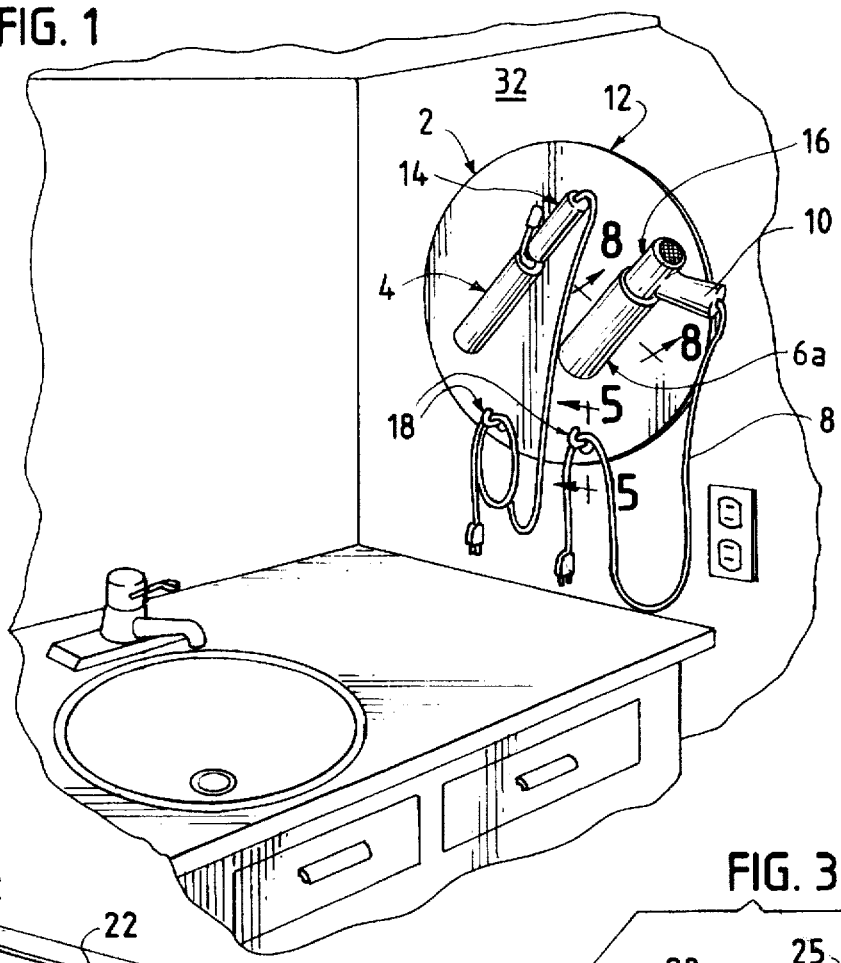
FIG. 1 is an illustrative perspective view of a preferred embodiment of the invention of a mountable adjustable holder apparatus for hair appliances attached to a wall.

Without departing from the generality of the invention disclosed herein, the discussion that follows, without limiting the scope of the invention, will refer to the invention as depicted in the drawing.

The preferred embodiments depicted in the drawing include a mountable adjustable holder apparatus for hair appliances. In FIG. 1, a flat rectangular base is depicted in the drawing. The base could have as easily have been shown as being disk shaped or non-planar—incorporating an irregularly shaped design. In a preferred embodiment the base has at least one aperture (24, 64, 84, 94, 104, 112, 120). Each of the apertures has a plurality of angulatingly discrete locking positions 25 relative to the base 12. Means for mounting are provided to mount the base on a permanent object, such as a door or a wall. At least one appliance securing member (4, 6, 6*a*, 80, 132, 134) is supplied, and means for attaching each of the appliance securing members selectively to one of the discrete locking positions of at least one of the apertures in the base allows a hair appliance to be held in position on the base at selected angular positions relative to the base.

In an other preferred embodiment of this invention, the mountable adjustable holder apparatus 2 for hair appliances comprises a base 12 having at least one aperture 22, means for mounting the base on a permanent object, at least one appliance securing member having at least one opening 30, each of the openings having a plurality of angulatingly discrete locking positions 25 relative to the appliance securing member, and means for attaching the base selectively to one of the discrete locking positions of at least one of the openings in the each of the appliance securing members, which allows the hair appliances to be held to the base at selected locking positions relative to the base.

The present invention discloses a novel connecting system comprising male connectors (plugs) and complementary female means for receiving which allow for angularly distinct locking positions relative to a securely positioned base.

It will be readily understood by one skilled in the art that a variety of angularly distinct interconnections between an appliance securing member and the base may be accomplished utilizing many known connectors having at least one connecting face with a symmetric array compatible with the aperture and/or opening of the base and appliance securing member, respectively.

Figure 28:
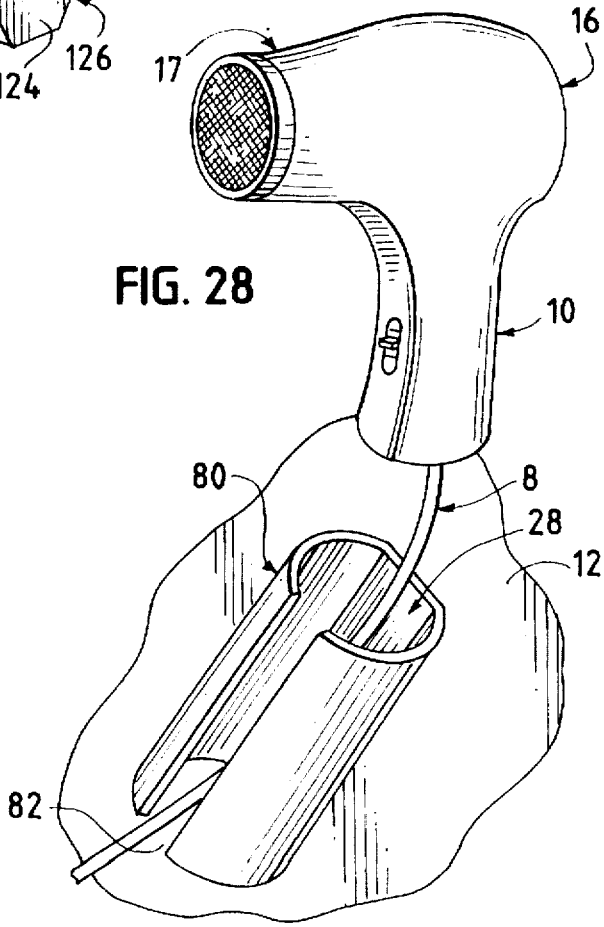
FIG. 28 is an illustrative perspective view of a preferred embodiment of an elongated cylindrical tube for receiving the handle of a hair dryer with a portion of the elongated cylindrical tube being flat along a length of the tube and a longitudinal for receiving the cord of the hair dryer.

In the preferred embodiment shown in the drawing, the base 12 of the mountable adjustable holder apparatus 2 for hair appliances is generally flat as shown in FIG. 1; and, as shown in FIG. 28, the appliance securing members comprise at least one generally elongated cylindrical tube 80 for receiving the handle 10 of a hair dryer 16 and with a slot 82 disposed longitudinally along the length of the tube 80 to allow an electric cord 8 of the hair dryer to pass through the slot 82.

Additionally, the appliance securing members may comprise at least one generally elongated cylindrical tube 4 for receiving the barrel of a curling iron 14. The curler iron barrel tube 4 is preferably made of and has an inner sleeve 3 made of a heat resistant material suitable to hold the barrel of the curling iron 4.

Figure 26:
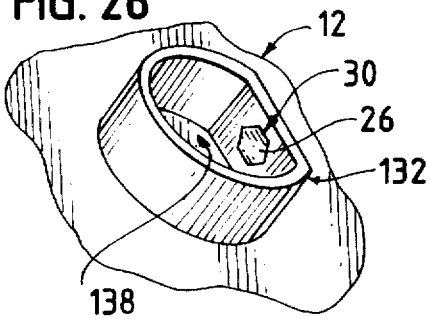
FIG. 26 is a fragmentary view of a generally ring-shaped securing member defining throat area for receiving the barrel of a hair dryer.
Figure 27:
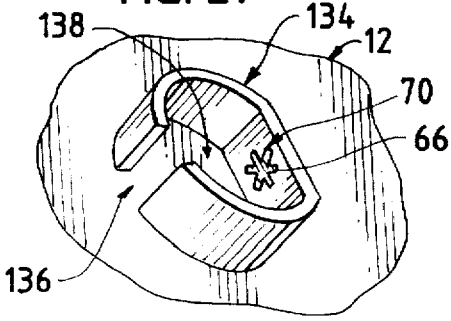
FIG. 27 is a fragmentary view of a generally C-shaped securing member defining a throat area for receiving the handle of a hair dryer with a slot for the cord of the hair dryer.

Alternative embodiments of the appliance securing members of the mountable adjustable holder apparatus 2 for hair appliances comprises at least one generally C-shaped member 134 defining a throat area 138 for receiving the handle of a hair dryer and a mouth opening 136 to allow an electric cord 8 of a hair dryer 16 to pass through the mouth opening; or at least one generally ring-shaped member 132 defining a throat area 138 for receiving the barrel of a hair dryer, as best shown in FIGS. 26 and 27.

Furthermore, the mountable adjustable holder apparatus for hair appliances may comprise at least one hook 18 operatively mounted on the base 12.

Moreover, a preferred embodiment of the invention provides a heat resistant tube or inner sleeve may be employed for the tube 4 of an appliance securing member to safely contain the heated barrel of a curling iron.

In a preferred embodiment of this functional invention, the means for attaching comprises a plug (26, 66, 68, 86, 102, 114, 116, 126) having at least one symmetric array lying in a plane parallel to the plane of the base 12 when in place in the aperture provided therefor, the appliance securing members each have an opening (30, 58, 70, 90, 100, 108, 110, 118, 128) adapted to securingly receive one of the symmetric arrays of the plug, and the apertures (24, 64, 84, 96, 104, 106, 112, 120) of the base 12 are adapted to securingly receive the plug. In this way, the appliance securing members may be selectively mounted to a plug disposed in one of the apertures in the base.

In another preferred embodiment, the means for attaching comprises a plug having at least one symmetric array lying in a plane parallel to the plane of the base, the appliance securing members each have an opening adapted to securingly receive the plug, and the apertures of the base are adapted to securingly receive one of the symmetric arrays of the plug, whereby, the appliance securing members may be mounted to a plug that is selectively disposed in one of the apertures in the base.

Furthermore, the means for attaching may comprise a plug having at least one symmetric array lying in a plane parallel to the plane of the base, the appliance securing members each have an opening adapted to securingly receive one of the symmetric arrays of the plug, and the apertures of the base are adapted to securingly receive one of the symmetric arrays of the plug, whereby, the appliance securing members may be selectively mounted to a plug that is selectively disposed in one of the apertures in the base. While the embodiments shown in FIGS. 8–11 and 14–15, show a uniform plug and correspondingly uniform base apertures and tube openings, it will be readily understood that only one of said holes need have the discrete locking positions to allow the appliance securing member to be angulatingly repositioned. Moreover, in such instances the entire length of the plug need not be uniform.

Alternatively, the means for attaching comprise an adhesive 34 disposed between the appliance securing means and a plug having at least one symmetric array lying in a plane parallel to the plane of the base, the apertures of the base are adapted to securingly receive one of the symmetric arrays of the plug, whereby, the appliance securing members may be mounted to a plug that is selectively disposed in one of the apertures in the base. The aperture of the base and the opening of the appliance securing member may be include a plurality of intersecting elongated tracts with the intersection occurring at the midpoint of the elongated tracts.

Figure 9:
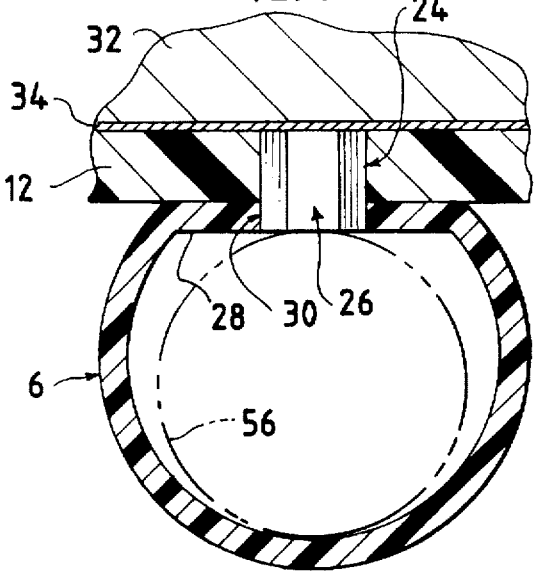
FIG. 9 is a fragmentary cross-sectional view taken generally in the plane of line 9—9 of FIG. 8 showing the base attached adhesively to a wall with the elongated cylindrical tube attached to the base with the hexagonal plug and the barrel of the hair dryer shown in phantom.

As shown in FIG. 9, a wall adhesive 34 is used to attach the base vertically to a wall with the elongated cylindrical tube of the hair dryer barrel tube attached to the base and with the barrel of hair dryer 56 shown in phantom.

Figure 16:
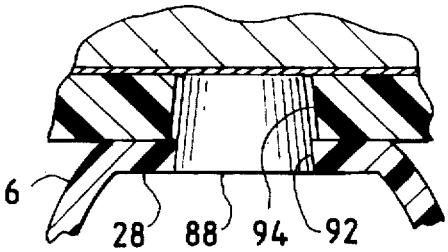
FIG. 16 is a fragmentary cross-sectional view showing a tapered plug having an oblong cross-section tapered from the securing means toward the base.
Figure 17:
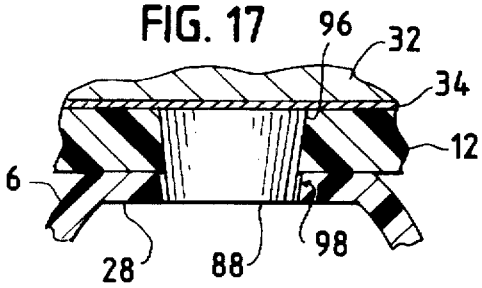
FIG. 17 is a fragmentary cross-sectional view showing a tapered plug having an oblong cross-section with the plug tapered from the base to the securing member.

Referring to FIG. 16, a tapered oblong plug 88 is shown adapted to fit into a tapered oblong opening 92 in the tube. The taper extends from the securing means toward the base. An alternative embodiment is shown in FIG. 17, a cross sectional with the plug having an oblong cross section which is adapted to fit into an oblong opening 98 in the tube tapered from the base to the securing member.

Figure 10:
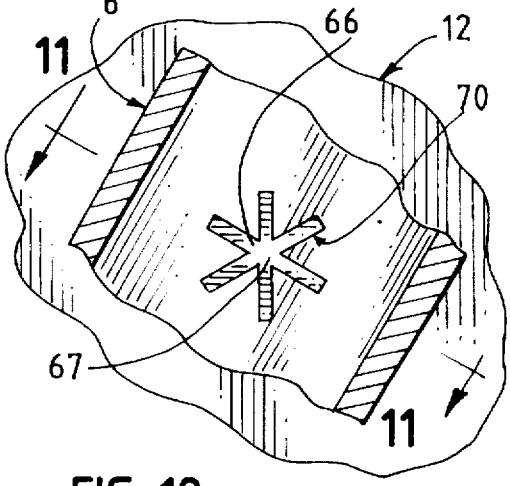
FIG. 10 is a fragmentary cross-sectional view taken in elevation of an elongated tube attached to the base in one discrete locking position with an elongated plug having a uniform cross-section that defines a central axis with a plurality of equally spaced spokes emanating radially from said axis.

As shown in FIG. 10 of the drawing, the means for attaching may comprise an elongated plug 66 having a uniform cross-section, the cross-section defining a central axis 67 with a plurality of equally spaced spokes 70 emanating radially from the axis, and wherein at least one of the apertures 64 in the base 12 has a complementary shape adapted to securingly receive the cross-section of the plug 66.

Figure 11:
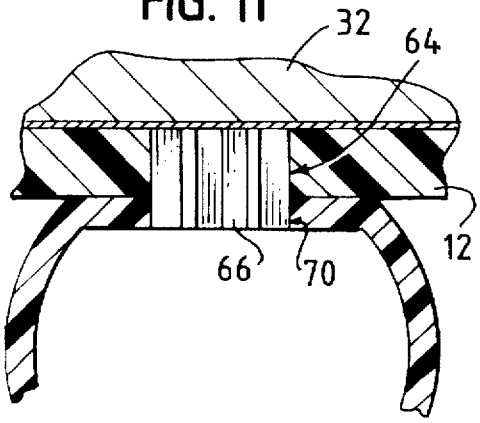
FIG. 11 is a fragmentary cross-sectional view taken generally in the plane of line 11—11 of FIG. 10 showing a portion of the elongated cylinder attached to the base by the elongated plug having a uniform cross-section that defines a central axis with a plurality of equally spaced spokes emanating radially from said axis.

Likewise, as shown in FIG. 11, the means for attaching may comprise an elongated plug having a uniform cross-section, the cross-section defining a central axis with a plurality of equally spaced spokes emanating radially from the axis, and wherein at least one of the appliance securing members has an opening 70 with a complementary shape adapted to securingly receive the cross-section of the plug.

Figure 8:
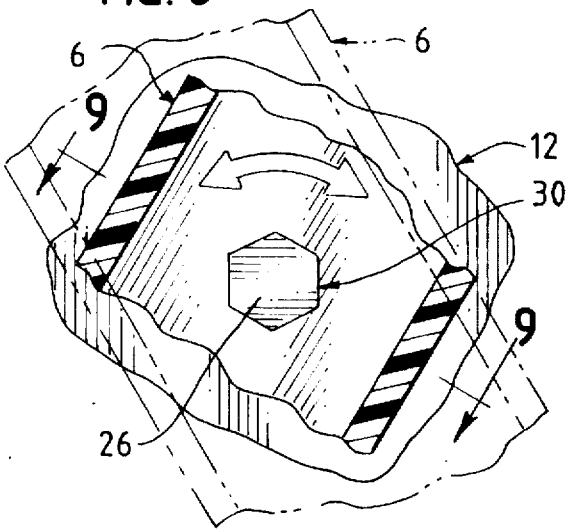
FIG. 8 is a fragmentary cross-sectional view in elevation of the elongated cylindrical tube for receiving the barrel of a hair dryer taken generally in the plane of line 8—8 of FIG. 1, showing said tube in one discrete locking position (while said tube is shown in a second discrete locking position in phantom) with the means for attaching being a hexagonal plug.

The mountable adjustable holder apparatus for hair appliances of the present invention with the means for attaching comprising an elongated plug having a uniform cross-section, the cross-section defining a polygon, and wherein at least one of the apertures in the base has a complementary shape adapted to securingly receive the cross-section of the plug is also disclosed. See FIGS. 8 and 8 showing a polygon having six sides.

As shown in the drawing, the means for attaching may further comprise an elongated plug having a uniform cross-section, the cross-section defining a polygon, and wherein at least one of the appliance securing members has an opening with a complementary shape adapted to securingly receive the cross-section of the plug.

It will be readily understood by those skilled in the art that various configurations allowing for angulating connections are contemplated although not all have been described. For example, a symmetric array of a plurality of projections engagable with a like number and array of recesses would similarly accomplish the objectives herein disclosed.

Figure 18:
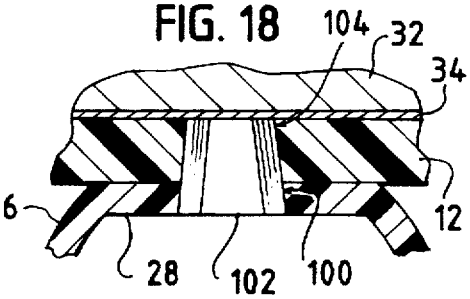
FIG. 18 is a fragmentary cross-sectional view showing a tapered polygonal plug tapering from the securing means toward the base.
Figure 19:
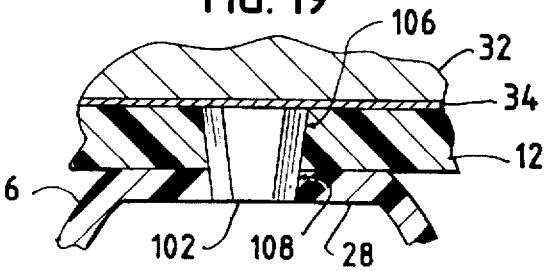
FIG. 19 is a fragmentary cross-sectional view showing a tapered polygonal plug tapering from the base toward the securing means.
Figure 20:
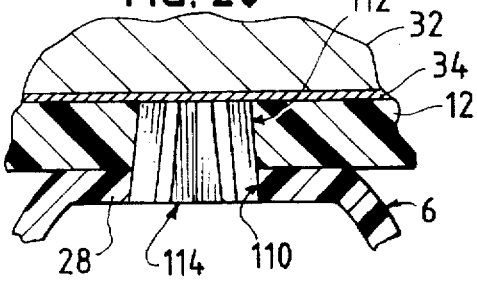
FIG. 20 is a fragmentary cross-sectional view showing a tapered elongated plug having a symmetrical cross-section that defines a central axis with a plurality of equally spaced spokes emanating radially from said axis tapering from the securing member to the base.
Figure 21:
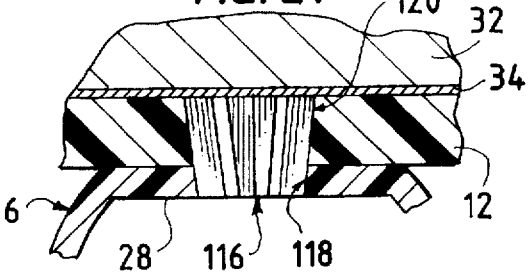
FIG. 21 is a fragmentary cross-sectional view showing a tapered elongated plug having a symmetrical cross-section that defines a central axis with a plurality of equally spaced spokes emanating radially from said axis tapering from the base to the securing member.
Figure 22:
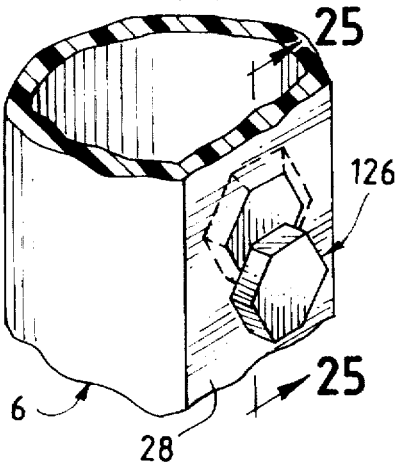
FIG. 22 is a fragmentary perspective view of a hair dryer barrel tube having an irregularly shaped aperture adapted to receive an irregularly shaped plug.
Figure 23:
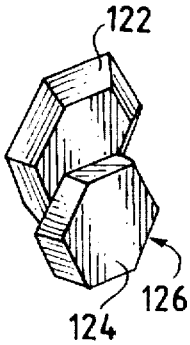
FIG. 23 is a perspective view of the irregularly shaped plug shown in FIG. 22.
Figure 24:
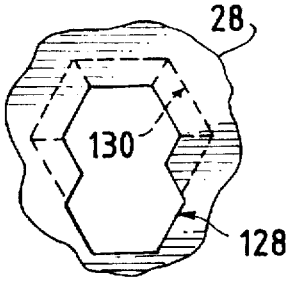
FIG. 24 is a fragmentary side view in elevation of a flat portion of the hair dryer barrel tube of FIG. 22 showing the irregularly shaped complementary opening with tapered sides on an interior surface of the tube.
Figure 25:
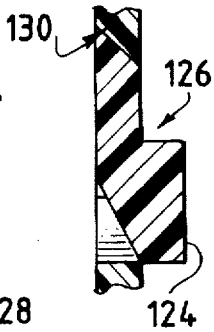
FIG. 25 is a fragmentary cross-sectional view in elevation of the opening and irregularly shaped plug taken generally in the plane of line 25—25 of FIG. 22 showing the tapered sides of the irregularly shaped complementary opening on the interior surface of the tube.

As shown in FIGS. 18–19, other preferred embodiments of the means for attaching are illustrated showing a tapered plug 102 having a cross-section defining a polygon may be employed, with at least one of the apertures (104, 106) in the base having a complementary tapered shape adapted to securingly receive the cross-section of the tapered plug.

Additionally, the means for attaching may comprise a tapered plug 102 having a cross-section defining a polygon, and wherein at least one of the appliance securing members has an opening (100, 108) with a complementary tapered shape adapted to securingly receive the cross-section of the plug.

Figure 12:
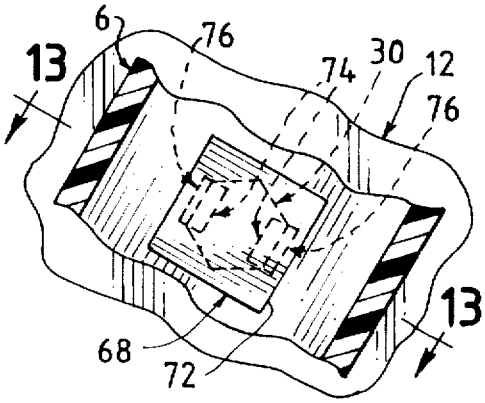
FIG. 12 is a fragmentary cross-sectional view in elevation of an elongated cylindrical tube having a hexagonal opening and a means for attaching comprising a multi-pronged clip having a square head, said prongs being in opposition to one another and being disposed against parallel surfaces of the opening.
Figure 13:
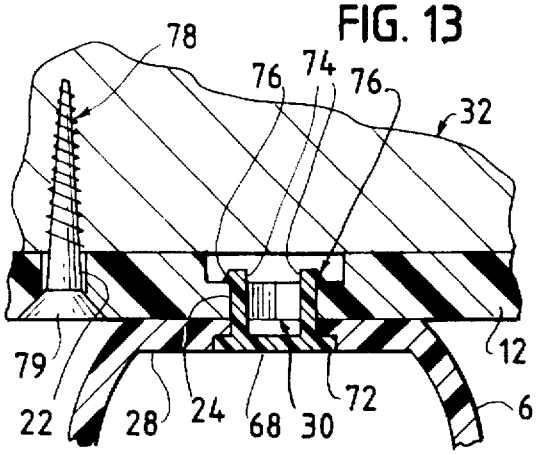
FIG. 13 is a fragmentary cross-sectional view taken generally in the plane of line 13—13 of FIG. 12 of the cylindrical tube, base, and wall showing the base attached to the wall with a threaded screw and the prongs of the clip having lateral protrusions to secure the clip within the opening of the tube and the aperture of the base.
Figure 14:
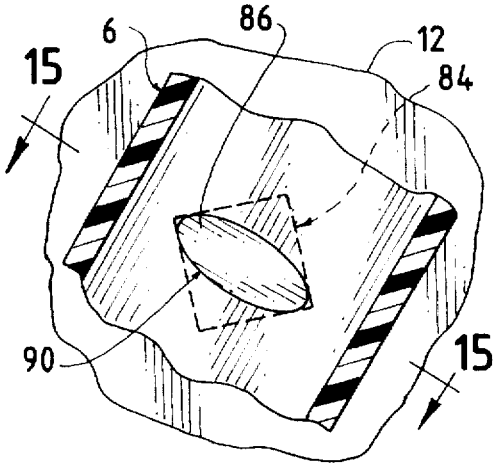
FIG. 14 is a fragmentary cross-sectional view in elevation of an elongated cylindrical tube having a hexagonal opening and a means for attaching comprising a plug having an oblong cross-section.
Figure 15:
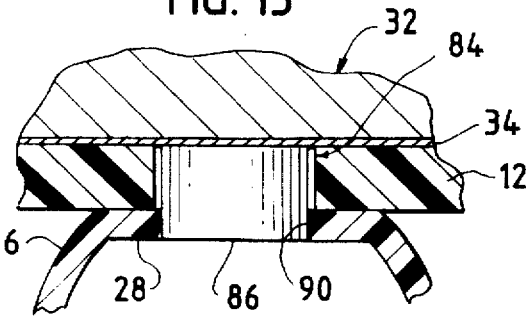
FIG. 15 is a fragmentary cross-sectional view of the base, tube and wall taken along the line of 15—15 of FIG. 14.

Alternatively, as best shown in FIGS. 12 and 13, a preferred embodiment of the mountable adjustable holder apparatus for hair appliances comprises a means for attaching having a multi-pronged clip 68 and wherein at least one of the apertures 30 in the base 12 comprises a regular polygon adapted to securingly receive the prongs 74 of the multi-pronged clip 68. In the drawing the clip has a rectangular head 72 and two opposing prongs 74, each having a outwardly projecting prong flange 76.

In another preferred embodiment of the present invention shown in FIGS. 22–25, the means for attaching comprises an irregularly shaped plug 126 having two generally parallel sides, one side having a tapered symmetric array 122 tapering toward the other parallel side and the other side having a cross-section defining a polygon 124, and at least one of the appliance securing members has a complementary opening 128 with a tapered shape 130 adapted to securingly receive the symmetric array 122 of the plug 126; and at least one of the apertures in the base comprises a complementary polygon adapted to securingly receive the side of the plug having a cross-section defining a polygon 124. In this way, the appliance securing members may be mounted to a plug selectively disposed in one of the apertures in the base.

Figure 29:
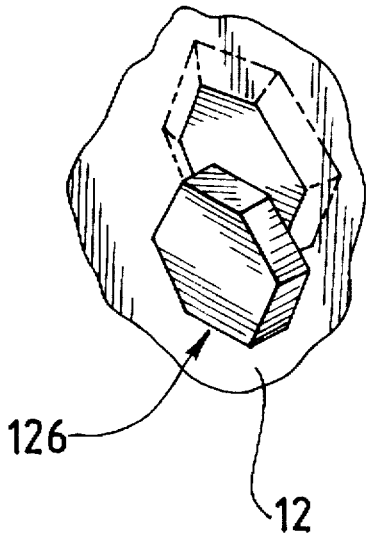
FIG. 29 is a fragmentary perspective view of an elongated tube with an irregularly opening and an irregularly shaped plug disposed in said tube with a hexagonal portion of the plug exposed from the wall of said tube.

Another preferred embodiment of the mountable adjustable holder apparatus for hair appliances shown in FIG. 29 provides means for attaching comprises an irregularly shaped plug 126 having two generally parallel sides, one side having a tapered symmetric array tapering toward the other side and the other side having a cross-section defining a polygon; and at least one of the appliance securing members has an opening defining a complementary polygon adapted to securingly receive the side of the plug having a cross-section defining a polygon; and at least one of the apertures in the base has a complementary tapered shape adapted to securingly receive the symmetric array of the plug, whereby, the appliance securing members may be selectively mounted to a plug disposed in one of the apertures in the base.

Figure 3:
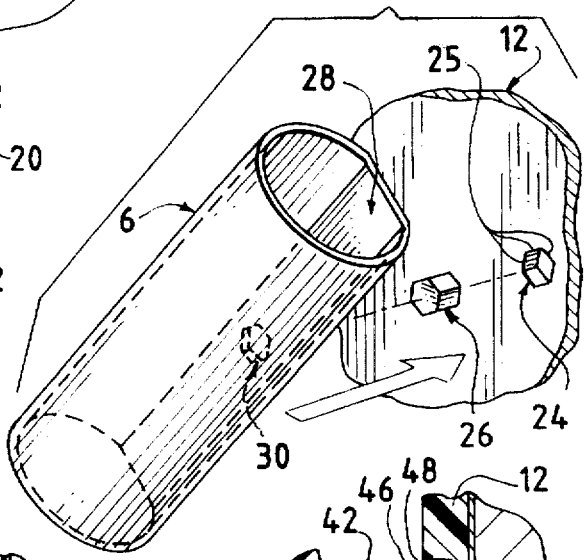
FIG. 3 is an exploded perspective view of an elongated cylindrical tube for receiving the barrel of a hair dryer with a portion of the elongated cylindrical tube being flat along a length of the tube with a hexagonal opening disposed in said flat portion exploded away from a hexagonal plug and showing also a fragmentary view of the base with a hexagonal aperture disposed therein.

A preferred feature of the current invention shown in FIG. 28 discloses a flat portion 28 of the elongated cylindrical tube 80 along the length of the tube with an opening 82 is disposed in the flat portion to engage the means for attaching. The flat portion is disposed in face to face relationship with the base, to facilitate mounting, as best shown in FIG. 3. The elongated tube 6*a* does not require a flat portion, as shown in FIG. 1, but such feature provides greater stability between the base and such member.

Figure 4:
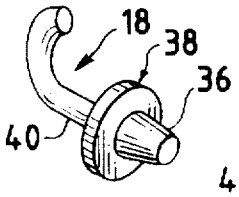
FIG. 4 is a perspective view of a hook with a tapered terminus.
Figure 5:
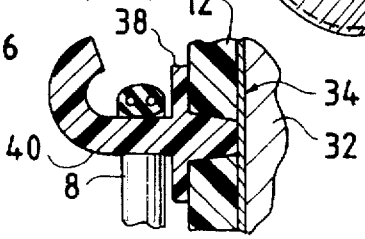
FIG. 5 is a cross-sectional view in elevation taken generally in the plane of line 5—5 of FIG. 1 of a hook having a tapered terminus with said tapered terminus disposed in corresponding tapered aperture in the base.
Figure 6:
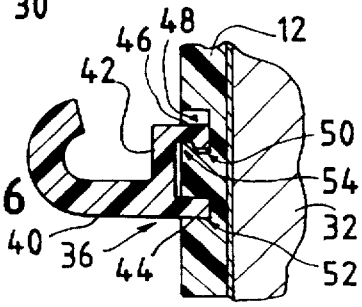
FIG. 6 is a cross-sectional view in elevation of a preferred embodiment of a hook of the current invention showing the hook with two generally horizontal legs one of which has a lateral notch, each of which may be received by a corresponding recess in the base.
Figure 7:
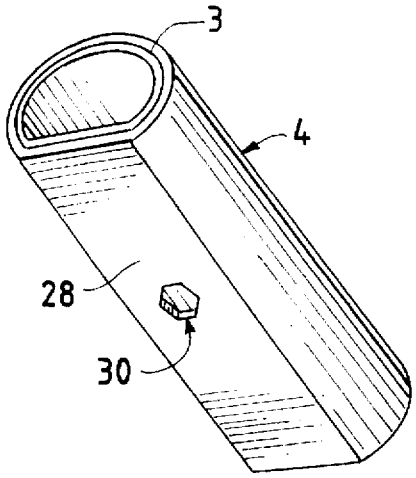
FIG. 7 is a perspective view of a preferred embodiment of an elongated cylindrical tube for receiving the barrel of a curling iron having a portion of the elongated cylindrical tube being flat along a length of the tube, a heat resistant sleeve, and a hexagonal opening disposed in said flat portion for engaging a means for attaching.

Referring to FIG. 6, another preferred feature shows the hook 18 having a shank 40 and a footing 36 comprising two generally horizontal legs (44, 46) disposed with an upper leg 46 above a lower leg 44 with the lower leg extending horizontally from the shank 40 and the upper leg having an intermediate portion 42 extending vertically from the shank and connected to a horizontal segment (the upper leg) 46 which is generally parallel to the lower leg. The horizontal segment 46 has a lateral notch 50 disposed adjacent to the intermediate portion 42 proximate to the lower leg 44, and the base 12 has means for securingly receiving the legs of the hook 18 comprising a lower recess 52 suitably sized to receive the lower leg 44 of the hook and an upper recess 48 disposed above the lower recess 52, suitably sized to receive the upper leg 46 of the hook, having an upwardly exposed nub 54 positioned to matingly engage the notch 50 of the upper leg 46 which may be disposed therein. The hook may alternatively have a conventional tapered footing 36 at the hook base 38 which may be press fit into a tapered hole in the base, as shown in FIGS. 4 and 5.

The base may be mounted on a wall with an adhesive 34 disposed between the wall 32 and the base 12. Alternatively, it may be mounted using a plurality of threaded screws 78 having a head 79 disposed in mating relationship with the base 12 and the threaded portion of the screws in a mating relationship with the wall 32, as shown in FIG. 13.

Figure 2:
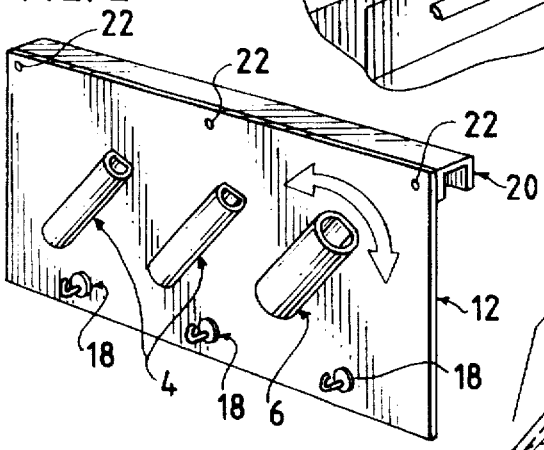
FIG. 2 is a perspective view of a preferred embodiment of the mountable adjustable holder apparatus for hair appliances showing a means for mounting the base on a door.

Referring to FIG. 2, another preferred embodiment of the invention is shown, wherein means for mounting the base on a door are disclosed comprising an elongated channel 20 having a pair of downwardly extending members, each member having an upper edge attached to an elongated side edge of a horizontal member, one of the downwardly extending members being attached to the base, and the elongated channel being suitably sized to have the horizontal member rest on an upper edge of a door.

The invention resides not in any one of these features per se, but rather in the particular combination of all of them herein disclosed and claimed and it is distinguished from the prior art in this particular combination of all of its structures for the function specified.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is a follows:

1. A mountable adjustable holder apparatus for hair appliances comprising:

a. a base having at least one aperture, each of said at least one aperture having a plurality of predetermined angulatingly discrete locking positions relative to the base;

b. means for mounting the base on a permanent object;

c. at least one appliance securing member; and d. means for attaching each of the at least one appliance securing member selectively to one of the plurality of predetermined angulatingly discrete locking positions of the at least one of the aperture in the base, whereby, the appliance securing members may be attached to the base at selected locking positions relative to the base.

2. The mountable adjustable holder apparatus for hair appliances of claim 1, wherein the base is generally flat.

3. The mountable adjustable holder apparatus for hair appliances of claim 1, wherein the at least one appliance securing member comprises at least one generally elongated cylindrical tube for receiving the handle of a hair dryer and with a slot disposed longitudinally along the length of said tube to allow an electric cord of the hair dryer to pass through said slot.

4. The mountable adjustable holder apparatus for hair appliances of claim 3, wherein the appliance securing members comprise at least one generally elongated cylindrical tube for receiving the barrel of a curling iron.

5. The mountable adjustable holder apparatus for hair appliances of claim 4, wherein the base is generally flat.

6. The mountable adjustable holder apparatus for hair appliances of claim 1, wherein the appliance securing members comprise at least one generally elongated cylindrical tube for receiving the barrel of a curling iron.

7. The mountable adjustable holder apparatus for hair appliances of claim 1, wherein the appliance securing members comprise at least one generally C-shaped member defining a throat area for receiving the handle of a hair dryer and a mouth opening to allow an electric cord of a hair dryer to pass through said mouth opening.

8. The mountable adjustable holder apparatus for hair appliances of claim 7, wherein the appliance securing members comprise at least one generally elongated cylindrical tube for receiving the barrel of a curling iron.

9. The mountable adjustable holder apparatus for hair appliances of claim 1, wherein the appliance securing members comprise at least one generally ring-shaped member defining a throat area for receiving the barrel of a hair dryer.

10. The mountable adjustable holder apparatus for hair appliances of claim 9, wherein the appliance securing members comprise at least one generally elongated cylindrical tube for receiving the barrel of a curling iron.

11. The mountable adjustable holder apparatus for hair appliances of claim 10, wherein the base is generally flat.

12. The mountable adjustable holder apparatus for hair appliances of claim 1, further comprising at least one hook operatively mounted on said base.

13. The mountable adjustable holder apparatus for hair appliances of claim 1, wherein the means for mounting the base on a permanent object comprises a means for mounting the base on a wall having an adhesive disposed between the wall and the base.

14. The mountable adjustable holder apparatus for hair appliances of claim 1, wherein the means for mounting the base on a permanent object comprises a means for mounting the base on a wall with a plurality of threaded screws having heads disposed in mating relationship with the base and the threaded portion of the screws in a mating relationship with the wall.

15. The mountable adjustable holder apparatus for hair appliances of claim 1, wherein the means for mounting the base on a permanent object comprises a means for mounting the base on a door comprising an elongated channel having a pair of downwardly extending members, each member having an upper edge attached to an elongated side edge of a horizontal member, one of said downwardly extending members being attached to the base, and said elongated channel being suitably sized to have the horizontal member rest on an upper edge of the door.

16. The mountable adjustable holder apparatus for hair appliances of claim 2, wherein the means for attaching comprises a plug having at least one symmetric array lying in a plane parallel to the plane of the base, said plane of the base being vertical, the appliance securing members each have an opening adapted to securingly receive one of the at least one symmetric array of said plug, and the apertures of the base are adapted to securingly receive said plug, whereby, the appliance securing members may be selectively mounted to a plug disposed in one of the apertures in the base.

17. The mountable adjustable holder apparatus for hair appliances of claim 2, wherein the means for attaching comprises a plug having at least plane parallel to array lying in a plane parallel to the plane of the base, said plane of the base being vertical, the appliance securing members each have an opening adapted to securingly receive said plug, and the apertures of the base are adapted to securingly receive one of the at least one symmetric array of said plug, whereby, the appliance securing members may be mounted to a plug that is selectively disposed in one of the apertures in the base.

18. The mountable adjustable holder apparatus for hair appliances of claim 2, wherein the means for attaching comprises a plug having at least one symmetric array lying in a plane parallel to the plane of the base, said plane of the base being vertical, the appliance securing members each have an opening adapted to securingly receive one of the at least one symmetric arrays of said plug, and the apertures of the base are adapted to securingly receive one of the at least one symmetric array of said plug, whereby, the appliance securing members may be selectively mounted to a plug that is selectively disposed in one of the apertures in the base.

19. The mountable adjustable holder apparatus for hair appliances of claim 2, wherein the means for attaching comprises an adhesive disposed between the appliance securing means and a plug having at least one symmetric array lying in a plane parallel to the plane of the base, said plane of the base being vertical, the apertures of the base are adapted to securingly receive one of the at least one symmetric arrays of said plug, whereby, the appliance securing members may be mounted to a plug that is selectively disposed in one of the apertures in the base.

20. The mountable adjustable holder apparatus for hair appliances of claim 2, wherein the means for attaching comprises an elongated plug having a uniform cross-section, said cross-section defining a central axis with a plurality of equally spaced elongated linearly shaped spokes emanating radially from said axis, and wherein at least one of the apertures in the base has a complementary shape adapted to securingly receive said cross-section of the plug.

21. The mountable adjustable holder apparatus for hair appliances of claim 2, wherein the means for attaching comprises an elongated plug having a uniform cross-section, said cross-section defining a central axis with a plurality of equally spaced elongated linearly shaped spokes emanating radially from said axis, and wherein at least one of the appliance securing members has an opening with a complementary shape adapted to securingly receive said cross-section of the plug.

22. The mountable adjustable holder apparatus for hair appliances of claim 2, wherein the means for attaching comprises an elongated plug having a uniform cross-section, said cross-section defining a central axis with a plurality of elongated linearly shaped spokes emanating radially from said axis, and wherein at least one of the apertures in the base has a shape adapted to securingly receive said cross-section of the plug.

23. The mountable adjustable holder apparatus for hair appliances of claim 2, wherein the means for attaching comprises an elongated plug having a uniform cross-section, said cross-section defining a central axis with a plurality of elongated linearly shaped s pokes emanating radially from said axis, and wherein at least one of the appliance securing members has an opening with a shape adapted to securingly receive said cross-section of the plug.

24. The mountable adjustable holder apparatus for hair appliances of claim 2, wherein the means for attaching comprises an elongated plug having a uniform cross-section, and wherein at least one of the apertures in the base comprises a plurality of intersecting elongated tracts with the intersection occurring at the midpoint thereof adapted to securingly receive said cross-section of the plug.

25. The mountable adjustable holder apparatus for hair appliances of claim 2, wherein the means for attaching comprises an elongated plug having a uniform cross-section, and wherein at least one of the appliance securing members has an opening adapted to securingly receive said cross-section of the plug said opening comprising a plurality of intersecting elongated tracts with the intersection occurring at the midpoint thereof.

26. The mountable adjustable holder apparatus for hair appliances of claim 2, wherein the means for attaching comprises a multi-pronged clip having at least two prongs in opposition to one another, and wherein at least one of the apertures in the base comprises a regular polygon adapted to securingly receive said multi-pronged clip with the at least two prongs in opposition to one another being disposed against parallel surfaces of the opening.

27. The mountable adjustable holder apparatus for hair appliances of claim 2, wherein the means for attaching comprises a multi-pronged clip having at least two prongs in opposition to one another, and wherein at least one of the appliance securing members has a complementary opening comprising a regular polygon adapted to securingly receive said multi-pronged clip with the at least two prongs in opposition to one another being disposed against parallel surfaces of the opening.

28. The mountable adjustable holder apparatus for hair appliances of claim 4, wherein a portion of the elongated cylindrical tube is flat along the length of the tube, an opening is disposed in said flat portion to engage the means for attaching, and the flat portion is disposed in face to face relationship with the base, to facilitate mounting.

29. A mountable adjustable holder apparatus for hair appliances comprising:

a. a base vertically disposed having at least one aperture;

b. means for mounting the base on a permanent object;

c. at least one appliance securing member having at least one opening, each of said at least one opening having a plurality of predetermined angulatingly discrete locking positions relative to the appliance securing member; and d. means for attaching the base selectively to one of the plurality of predetermined angulatingly discrete locking positions of said at least one opening in the each of the appliance securing members, whereby, the appliance securing members may be attached to the base at selected locking positions relative to the vertical base.

30. A mountable adjustable holder apparatus for hair appliances comprising:

a. a generally flat base having at least one aperture, each of said apertures having a plurality of angulatingly discrete locking positions relative to the base;

b. means for mounting the base on a permanent object;

c. at least one appliance securing member; and d. means for attaching each of the appliance securing members selectively to one of the discrete locking positions of at least one of the apertures in the base, said means for attaching comprising an irregularly shaped plug having two generally parallel sides, one side having a tapered symmetric array tapering toward the other side and the other side having a cross-section defining a polygon, and wherein at least one of the appliance securing members has a complementary opening with a tapered shape adapted to securingly receive said symmetric array of the plug; and wherein at least one of the apertures in the base comprises a complementary polygon adapted to securingly receive the side of the plug having a cross-section defining a polygon, whereby, the appliance securing members may be mounted to a plug selectively disposed in one of the apertures in the base and the appliance securing members may be attached to the base at selected locking positions relative to the base.

31. A mountable adjustable holder apparatus for hair appliances comprising:

a. a generally flat base having at least one aperture, each of said apertures having a plurality of angulatingly discrete locking positions relative to the base;

b. means for mounting the base on a permanent object;

c. at least one appliance securing member; and d. means for attaching each of the appliance securing members selectively to one of the discrete locking positions of at least one of the apertures in the base, said means for attaching comprising an irregularly shaped plug having two generally parallel sides, one side having a tapered symmetric array tapering toward the other side and the other side having a cross-section defining a polygon; and wherein at least one of the appliance securing members has an opening defining a complementary polygon adapted to securingly receive the side of the plug having a cross-section defining a polygon; and wherein at least one of the apertures in the base has a complementary tapered shape adapted to securingly receive said symmetric array of the plug, whereby, the appliance securing members may be selectively mounted to a plug disposed in one of the apertures in the base and the appliance securing members may be attached to the base at selected locking positions relative to the base.

32. A mountable adjustable holder apparatus for hair appliances comprising:

a. a base having at least one aperture, each of said apertures having a plurality of angulatingly discrete locking positions relative to the base;

b. means for mounting the base on a permanent object;

c. at least one appliance securing member;

d. means for attaching each of the appliance securing members selectively to one of the discrete locking positions of at least one of the apertures in the base, whereby, the appliance securing members may be attached to the base at selected locking positions relative to the base; and e. at least one hook operatively mounted on said base, said hook has a shank and a footing comprising two generally horizontal legs disposed with an upper leg above a lower leg, said lower leg extends horizontally from the shank and the upper leg has an intermediate portion extending vertically from the shank and connected to a horizontal segment which is generally parallel to the lower leg, said horizontal segment having a lateral notch disposed adjacent to the intermediate portion proximate to the lower leg, and wherein the base has means for securingly receiving the legs of said hook comprising a lower recess suitably sized to receive the lower leg of the hook and an upper recess disposed above the lower recess, suitably sized to receive the upper leg of the hook, having an upwardly exposed nub positioned to matingly engage the notch of the upper leg which may be disposed therein.

* * * * *